US005798605A

United States Patent [19]

Lambert et al.

[11] Patent Number: 5,798,605

[45] Date of Patent: Aug. 25, 1998

[54] THIN-TYPE DISPLAY DEVICE

[75] Inventors: Nicolaas Lambert; Theunis S. Baller; Gerardus G. P. Van Gorkom; Edwin A. Montie; Petrus H. F. Trompenaars; Siebe T. De Zwart, all of Eindhoven, Netherlands

[73] Assignee: U.S. Philips Corporation, New York, N.Y.

[21] Appl. No.: 798,347

[22] Filed: Feb. 10, 1997

[30] Foreign Application Priority Data

Feb. 9, 1996 [EP] European Pat. Off. ..... 96200304

[51] Int. Cl.[6] ..... H01J 31/00

[52] U.S. Cl. ..... 313/422; 313/495; 313/105 CM; 315/169.1

[58] Field of Search ..... 313/422, 495, 313/496, 497, 103 CM, 105 CM; 315/169.1; 345/74, 75

[56] References Cited

U.S. PATENT DOCUMENTS 5,313,136 5/1994 Van Gorkom et al. ..... 313/422

5,347,199 9/1994 Van Gorkom et al. ..... 313/422

5,497,046 3/1996 Van Gorkom et al. ..... 313/422

FOREIGN PATENT DOCUMENTS

WO9429893 12/1994 WIPO ..... H01J 31/12

*Primary Examiner*—Sandra L. O'Shea
*Assistant Examiner*—Michael Day
*Attorney, Agent, or Firm*—Robert J. Kraus

[57] ABSTRACT

The thin-type display device (1) with a vacuum envelope has a transparent front wall (3), which is provided with a display screen, and at least an electron source (5) and a duct structure, which cooperates with the electron source (5) and which extends substantially parallel to the front wall (3). Ducts (6, 6', 6") of the duct structure serve as electron-propagation means and are provided with walls (11, 11', 11") of an electrically insulating material having a secondary emission coefficient which is suitable for electron propagation. In the display device (1) $1 \leqq s/w \leqq 5$ and $s \cdot w \geqq 5$ mm$^2$, where s is the depth of the ducts (6, 6', 6") and w is the width of the ducts (6, 6', 6"). Preferably, the width $w \geqq 1.5$ mm and the depth $3.5 \leqq s \leqq 15$ mm. The voltage difference over the length of the ducts (6, 6', 6"), measured parallel to the front wall (3), is less than 75 V/cm, preferably less than 40 V/cm.

10 Claims, 3 Drawing Sheets

THIN-TYPE DISPLAY DEVICE

BACKGROUND OF THE INVENTION

The invention relates to a thin-type display device which has a vacuum envelope and which comprises a transparent front wall, which is provided with a display screen having a pattern of luminescent pixels, which display device includes at least an electron source and a duct structure, which cooperates with said electron source and which extends substantially parallel to the front wall, the ducts of the duct structure comprising electron-propagation means with walls of an electrically insulating material having a secondary emission coefficient which is suitable for electron propagation, said electron-propagation means cooperating with the electron source for transporting emitted electrons.

Thin-type display devices are used to display monochromatic or color images in vacuum tubes.

A display device of the type mentioned in the opening paragraph is disclosed in U.S. Pat. No. 5,313,136 (PHN 12.927), in which a description is given of a thin-type display device, which uses (multiple) electron currents which initially extend substantially parallel to the plane of the front wall and are finally constrained to move in a direction perpendicular to the display screen so as to address the desired luminescent pixels of the display screen by means of, for example, an addressing system. In the known display device, the ducts of the duct structure comprise so-called electron-propagation means having walls of an electrically insulating material whose secondary emission coefficient is suitable for electron propagation, said electron-propagation means cooperating with the electron source to transport emitted electrons through vacuum. The electron currents to be guided by the electron-propagation means can be generated by means of an electron source or an assembly of a number of electron sources. The electron currents generated by the electron source(s) are guided over at least a part of the height (or width) of the display device in the direction of one of the edges of the display screen by means of the propagation means. To enable the electron current to leave the electron-propagation means in desired (successive) places, a propagation means can be provided with a row of apertures with electrodes which can be energized to withdraw an electron current, at the location of a predetermined aperture, from its propagation means and direct it towards a desired pixel.

A disadvantage of the known display device resides in that an increase of the dimensions of the device and hence of the length of the ducts, causes the (propagation) voltage to be applied across the propagation means (ducts) (over the length thereof) to increase in proportion with the length of the ducts. Consequently, an increase in the dimensions of the device causes a further increase of the voltage to be applied across the ducts (over the length thereof) and hence a proportional increase in the energy consumption of the display device.

OBJECTS AND SUMMARY OF THE INVENTION

It is an object of the invention to provide a thin-type display device, in which an increase of the length of the propagation means (ducts) is accompanied by a smaller increase of the energy necessary to propagate electron(s) (currents) in the ducts of the duct structure.

To this end, the display device in accordance with the invention is characterized in that $1 \leqq s/w \leqq 5$ and $s \cdot w \geqq 5$ $mm^2$, where s indicates the depth of the ducts and w denotes the width of the ducts.

The inventors have recognized that the (propagation) voltage per unit of length decreases over the length of the ducts if the width of the ducts of the duct structure is increased. If only the width w of the ducts is increased, while the depth of the ducts remains constant, the ratio s/w, the so-called internal aspect ratio, decreases. If the ducts become too shallow relative to the width of the ducts, that is if $s/w<1$, the necessary (propagation) voltage per unit of length increases again, which is unfavorable.

In general, electron propagation takes place via so-called "hopping" across the walls of the ducts of the duct structure, preferably the wall of the ducts facing away from the front wall, which wall extends parallel to the plane of the front wall (for example the rear wall of the thin-type display device). A substantial increase in the depth of the ducts relative to the width, that is if the internal aspect ratio $s/w>5$, causes the stability of the propagation of the electrons on the wall to decrease, and it becomes more difficult to withdraw the electron current from its propagation means and direct it towards a desired pixel.

By increasing the width w of the ducts and, simultaneously, the depth s of the ducts, so that the internal aspect ratio satisfies the condition $1 \leqq s/w \leqq 5$, and $s \cdot w \geqq 5$ $mm^2$, which product is proportional to the sectional area of the duct of the duct structure, the (propagation) voltage per unit of length across the ducts (over the length thereof) decreases. As a result, the consumption of energy necessary to propagate electron(s) (currents) in the ducts of the duct structure increases at a smaller rate than the increase in the length of the ducts.

In the known display device a description is given of a duct structure which comprises ducts having a square shape ("square cross-section"), a section ("rib") of 1 mm and a duct pitch ("pitch") of 1 mm. If the walls between the ducts have an average thickness of approximately 0.1 mm, this corresponds to a width w=0.9 mm and a depth s=1.0 mm of the ducts, in other words $s/w=1.1$ and $s \cdot w=0.9$ $mm^2$. According to the description of the known display device, the voltage difference must increase if the depth of the ducts increases ("the deeper the cavities, the higher the voltage which will be required to operate the device"), which is in opposition to the idea on which the invention is based.

In the known display device, a voltage difference of 6 kV is necessary to bring about sufficient electron propagation throughout the length of the duct. In FIG. 10 and the associated description in U.S. 5,313,136, a description is given of a measure for reducing the (propagation) voltage over the length of the ducts by placing the electron source not in the vicinity of one of the end portions of the ducts (near an edge of the display device), but in the center of the ducts of the duct structure. Instead of applying a voltage difference of 6 kV throughout the length of the duct, it is proposed to apply a voltage difference of 3 kV between the center of the ducts and a first end portion of the ducts to draw an electron current from the center to the first end portion and, in addition, to apply a similar voltage difference between the center and a second end portion of the duct to draw an electron current from the center to the second end portion. The measure described in the known display device does lead to a reduction of the voltage required, yet per channel the energy necessary for electron propagation does not decrease. In addition, positioning the electron source or the assembly of a number of electron sources gives rise to uniformity problems in the ducts, particularly near the location where the electron source or assembly of a number of electron sources is connected to the ducts, and hence leads to intensity differences between (adjacent) pixels of the display screen, which differences in intensity are undesirable.

In general, the electron currents to be guided by the electron-propagation means are generated by an electron source or an assembly of a number of electron sources, for example an assembly of juxtaposed (line) cathodes of which segments generate electrons which are introduced into the propagation means by means of (entrance) apertures (electrodes). If the ducts are relatively narrow, the effectiveness with which electrons are generated by the electron source and introduced into the ducts varies over the length of the (line) cathode. If the (entrance) apertures between the electron source and the ducts of the duct structure are too closely spaced, the electron current in a duct adversely affects the electron current in an adjacent duct. This phenomenon, also referred to as "crosstalk", causes undesirable deviations in the electron currents between (adjacent) ducts, which adversely affects the homogeneity of the image displayed. If the ducts are widened, the intensity and homogeneity of the electron current of each duct increases, because the length of the segment of the (line) cathode of the electron source, from which the electron current for the duct is withdrawn, increases and the distance between the (entrance) apertures increases too.

A further advantage of widening the ducts of the duct structure in accordance with the invention is that the vacuum balance of the display device is favorably influenced and the effectiveness of a getter, if present in the display device, increases.

An embodiment of the display device in accordance with the invention is characterized in that $1.5 \leqq s/w \leqq 2.5$.

Experiments have shown that, if the ducts are substantially rectangular in cross-section, that is the walls of the ducts are at right angles to each other, an optimum (propagation) voltage per unit of length over the length of the ducts is obtained at an internal aspect ratio s/w which ranges between 1.5 and 2.5, and which is preferably substantially equal to 2. If the ducts have different shapes, for example if the walls of the duct structure narrow or widen in the direction of the front wall, the optimum voltage per unit of length over the length of the ducts is obtained at an internal aspect ratio s/w which ranges from 1.5 to 2.5.

An embodiment of the display device in accordance with the invention is characterized in that the width w of the ducts is larger than 1.5 mm. Preferably, the width w of the ducts is larger than 2 mm. An advantage of ducts having a width w above 1.5 mm is that, relative to the known display device, fewer ducts per unit area of the display screen are required. Such a larger, so-called pitch simplifies the construction of the duct structure. If the duct structure is composed, for example, of individual walls, which have all been manufactured separately and connected to a (rear) wall by means of a connection technique (for example by means of adhesives or so-called "fritting"), a smaller number of these separate walls are required. If the duct structure is manufactured, for example, in a single piece in which ducts are formed by means of etching, grinding or pressing, a more robust duct structure is obtained by widening the ducts.

A preferred embodiment of the display device in accordance with the invention is characterized in that the depth s of the ducts is larger than 3.5 mm. Preferably, the depth s of the ducts is larger than 4 mm. An advantage of ducts having a depth s above 3.5 mm is that, relative to the known display device, the risk that an electron leaves the electron-propagation means (via apertures which are in communication with one or more pixels) and reaches a pixel is reduced.

If the depth w of the ducts exceeds 1.5 mm, for example $w \geqq 2$ mm, and the depth s of the ducts exceeds 3.5 mm, preferably $s \geqq 4$ mm, the tolerance with which the duct structure is manufactured can be reduced in general, without a decrease in the homogeneity and uniformity of the electron currents in the ducts. By virtue thereof, undesirable differences in intensity between (adjacent) pixels or rows or columns of pixels, corresponding to the ducts, on the display screen are precluded.

A further embodiment of the display device in accordance with the invention is characterized in that the depth s of the ducts is less than 15 mm.

If the depth s of the ducts is chosen to be larger than 15 mm, the energy required to withdraw an electron current from the duct and direct it towards a desired pixel increases disproportionately, thereby adversely affecting the energy efficiency of the display device.

A preferred embodiment of the display device in accordance with the invention, in which the display device comprises an (entrance) aperture between the electron source and the ducts, is characterized in that the surface area of the aperture is larger than 1 $mm^2$ and the largest dimension of the aperture exceeds 0.5 s, that is the largest dimension of the aperture is larger than half the depth s of the ducts.

If the ducts are widened, the size of the hole of the (entrance) aperture (electrode), through which the electron current, generated by the electron source, enters the electron-propagation means, can increase (proportionally). This results in a higher efficiency of the electron source because a smaller surface area of the wire of the line cathode remains "unused" for emission. In addition, the increase of the (entrance) aperture causes the influence of the edge of the aperture on the electron current to decrease, which leads to an improved uniformity of the electron current per duct.

In a further embodiment of the display device in accordance with the invention, a separate unit is used, in which the electron source or the assembly of electron sources is accommodated. The expression "separate unit" is to be understood to mean herein that the electron source and the duct structure are not integral. The alignment of the electron source (or of an assembly of a number of electron sources) is simplified if the ducts, which form the electron-propagation means, are widened.

A further embodiment of the display device in accordance with the invention is characterized in that, in operation, the voltage difference per unit of length, measured over the length of the ducts in a direction parallel to the front wall, is less than 75 V/cm. In the known display device, a duct structure having relatively narrow ducts requires a voltage difference over the length of the ducts from at least 100 V/cm to (several) hundred(s) (of) volts per cm to propagate the electrons through the ducts. By increasing the width w and, simultaneously, the depth s of the ducts, so that $1 \leqq s/w \leqq 5$ and $s \cdot w \geqq 5$ $mm^2$, a corresponding reduction of the (propagation) voltage is attained. By further increasing the width of the ducts, a voltage difference per unit of length over the length of the ducts of less than 40 V/cm is sufficient. By virtue thereof, a considerable reduction of the energy necessary to propagate electron(s) (currents) in the ducts of the duct structure and hence of the energy consumption of the display device is achieved.

These and other aspects of the invention will be apparent from and elucidated with reference to the embodiments described hereinafter.

BRIEF DESCRIPTION OF THE DRAWINGS

In the drawings.

The Figures are purely schematic and not drawn to scale. In particular for clarity, some dimensions are exaggerated strongly. In the Figures, like reference numerals refer to like parts.

DESCRIPTION OF THE PREFERRED EMBODIMENTS

Figure 1A:
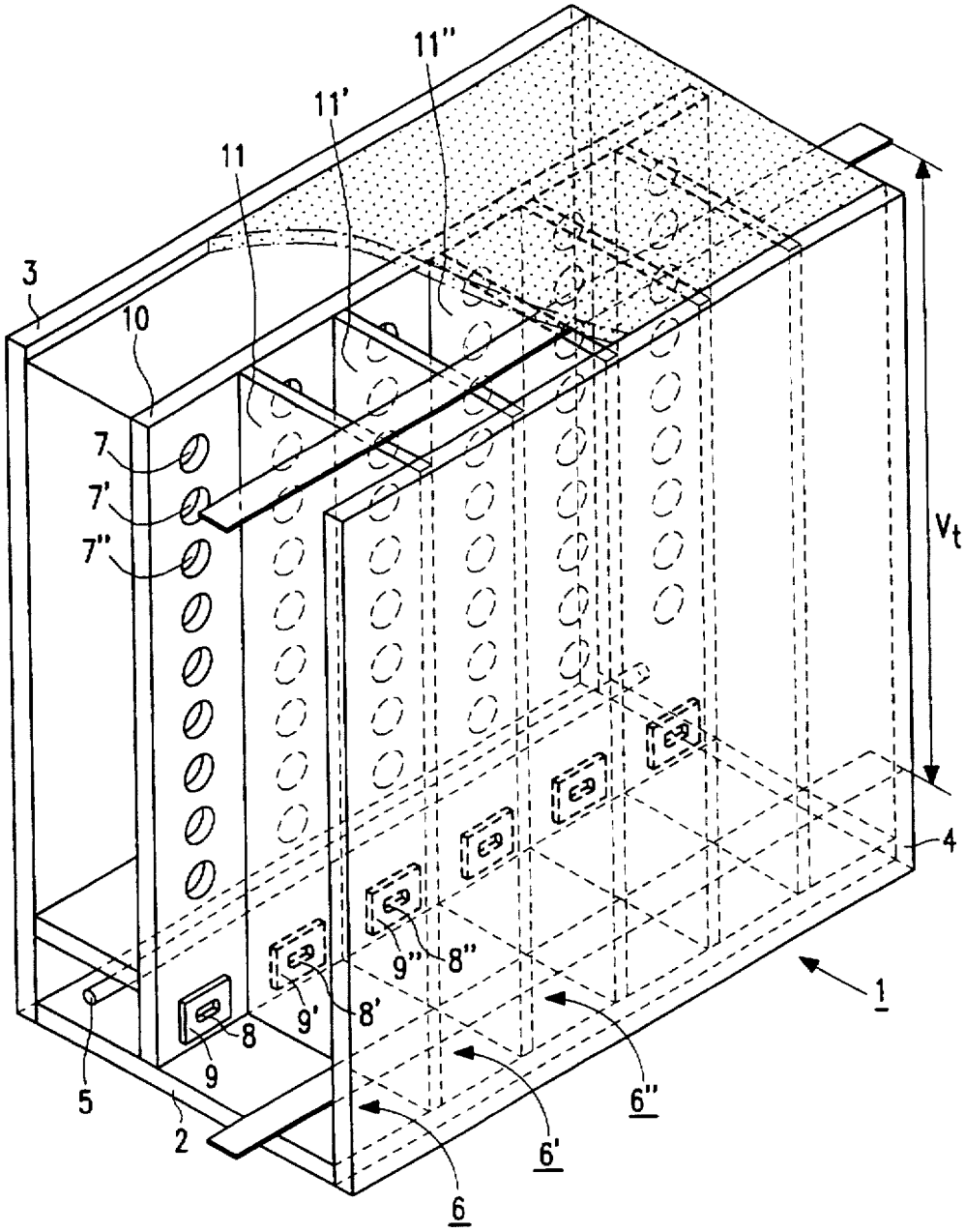
FIG. 1A is a schematic, perspective view, partly broken away, of a part of a construction of a thin-type display device in accordance with the invention.

FIG. 1A is a schematic, perspective view, partly broken away, of a part of a construction of the thin-type display device 1 in accordance with the invention. The display device comprises a front wall (window) 3 and an oppositely located rear wall 4, which extends parallel to said front wall 3. On the inner surface of the front wall 3, there is provided a display screen comprising a (regular) pattern of pixels luminescing, respectively, in red, green and blue. At least an electron source 5 is arranged in the vicinity of an upright side wall 2, which interconnects the front wall 3 and the rear wall 4. Said electron source 5 includes, for example, a cathode arrangement having one or more line cathodes or a large number of separate electrodes. The electron source 5 may form part of a separate unit, which is accommodated in the display device. A number of electron-propagation means, which cooperate with the electron source, are arranged next to the electron source 5, said electron-propagation means being formed by ducts 6, 6', 6" etc., which are separated from the electron-propagation means by walls 11, 11', 11" etc., which extend at right angles to the rear wall 4 and form the ducts of a so-called duct structure with said rear wall. The electron-propagation means cooperate, via a cathode plate having (entrance) apertures 8, 8', 8" and electrodes 9, 9', 9" etc., with the electron source 5 and extend substantially parallel to the front wall. In the example of FIG. 1A, the apertures 8, 8', 8" are rectangular. In alternative embodiments, the apertures 8, 8', 8" may have square, round, oval or other shapes. In a further alternative embodiment of the display device 1, the electron source 5 is arranged in the extension of the duct structure.

The electron-propagation means serve to transport the electrons emitted by the electron source 5 through vacuum. A plate 10, which closes the ducts 6, 6', 6" etc., is provided with apertures 7, 7', 7" etc., which guide the electrons to the display screen. Said plate 10 may alternatively comprise an assembly of various plates. A voltage $V_r$, which is applied over the length of the ducts 6, 6', 6", and/or an increasing potential across (electrodes in) the apertures 7, 7', 7" etc., serve(s) to propagate the electrons in the ducts. In general, an addressing system for addressing desired pixels is arranged between the duct structure and the front wall 3.

Figure 1B:
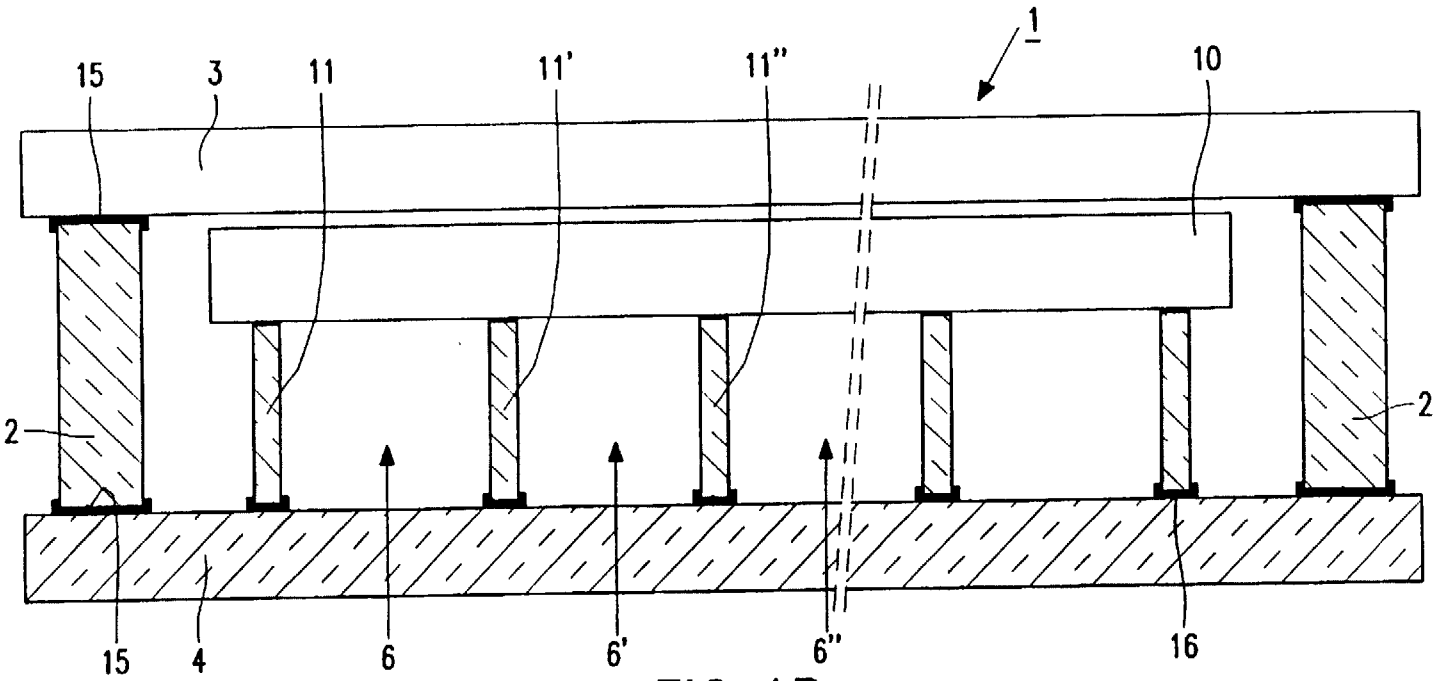
FIG. 1B shows, in cross-section, a plan view of the construction of FIG. 1A, and FIGS. 2A and 2B are cross-sectional views of embodiments of the rear wall and the walls of the ducts of the duct structure in accordance with the invention.

FIG. 1B is a schematic cross-section of a plan view of the construction of the thin-type display device 1 in accordance with the invention. The front wall (window) 3 is held at a distance from the rear wall 4 by the upright side walls 2. Said side walls 2 are connected to the front wall 4 and the rear wall 3 by means of vacuum-tight connections 15 (formed, for example, by means of a suitable adhesive or a so-called (glass) frit). The electron-propagation means cooperating with the electron source (not shown) are formed by the ducts 6, 6', 6" etc., which are separated from each other by walls 11, 11', 11" etc., which extend at right angles to the rear wall 4 and form the ducts of a so-called duct structure with said rear wall. Electrons are guided to the display screen via apertures (not shown) in plate 10. Said plate 10 generally includes an addressing system for addressing desired (luminescent) pixels and may alternatively include an assembly of various plates.

The walls 11, 11', 11" etc. of the ducts of the duct structure are connected to the rear wall by means of connections 16. It is alternatively possible to first mount said walls 11, 11', 11" etc. on (and connect them to) an auxiliary plate, whereafter said auxiliary plate with the walls 11, 11', 11" etc. is positioned on the rear walls and, if necessary, connected thereto. The use of an auxiliary plate on which the walls 11, 11', 11" etc. are provided has advantages if the material used for said walls 11, 11', 11" etc. differs from that used for the rear wall 4. In an alternative embodiment, the walls 11, 11', 11" etc. (whether mounted on an auxiliary plate or not) are connected to plate 10.

Figure 2A:
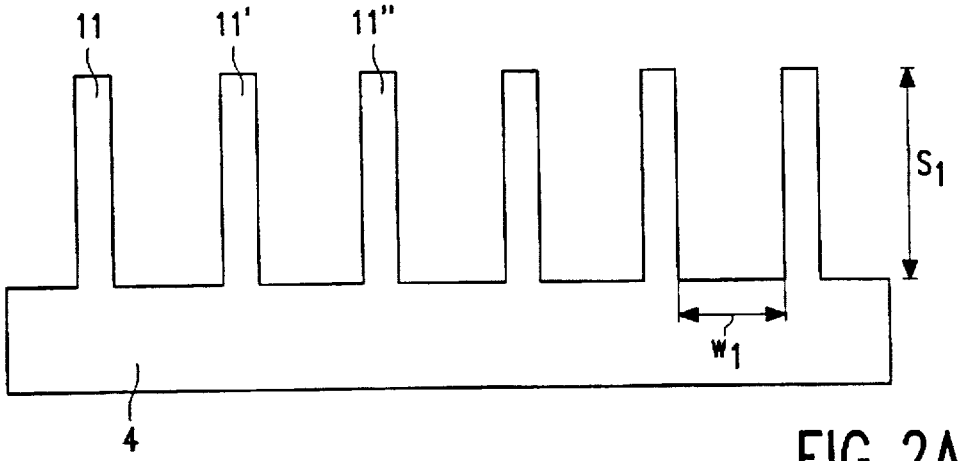

FIG. 2A is a schematic, cross-sectional view of an embodiment of the rear wall 4 and the walls 11, 11', 11" etc. of the ducts of the duct structure in accordance with the invention. The depth of the ducts and the width of the walls, etc. of the ducts of the duct structure (the ducts) are indicated, in FIG. 2A, by the distance $s_1$ and the width $w_1$, respectively. In this example, the opposing faces of the walls 11, 11', 11" etc. extend parallel to each other and the rear wall 4 and the walls 11, 11', 11" etc. form a so-called solid unit, that is to say that the rear wall 4 and the walls 11, 11', 11" etc. are manufactured from a single piece of one material without using a connection technique. The advantages of such a construction reside in that no connection technique has to be used, the walls 11, 11', 11" etc. are accurately positioned on the rear wall and the number of parts from which the display device is built up is reduced considerably.

The walls 11, 11', 11" etc. of the ducts 6, 6', 6" etc. are preferably made of a ceramic material, (quartz) glass or a synthetic resin, which walls may or may not be provided with a coating (for example a ceramic material such as MgO) and have an (effective) secondary emission coefficient, over a specific range of primary electron energies, which is predominantly equal to 1. The electric resistance of the wall material should be so high that, at a potential difference below 75 V/cm, preferably below 40 V/cm, a minimum amount of current flows in the walls (preferably less than, for example, 10 mA).

In an embodiment of the display device 1, the pitch is equal to 2 mm, which is twice as large as that of the known display device. If the walls between the ducts have an average thickness of approximately 0.25 mm, this corresponds to a width of the ducts of $w_1$=1.75 mm. If the depth of the ducts $s_1$=3.5 mm, then $s_1/w_1$=2.0 and $s_1 \cdot w_1$=6.1 $mm^2$. The ratio $s_1/w_1$, the so-called internal aspect ratio, ranges between 1 and 5, and in the preferred range, between 1.5 and 2.5. The product $s_1 \cdot w_1$, which in the case of a rectangular duct structure corresponds to the cross-sectional area of a duct of the duct structure, is equal to or larger than 5 $mm^2$. In this embodiment, a (propagation) voltage per unit of length of approximately 70 V/cm in the ducts is sufficient.

In a preferred embodiment of the display device 1, the pitch is 3 mm, which is thrice as large as that of the known display device. If the walls between the ducts have an average thickness of approximately 0.5 mm, this corresponds to a width of the ducts of $w_1$=2.5 mm. If the depth of the ducts $s_1$=5.0 mm, then this depth is in the preferred range from 4 to 15 mm, and, as a result, $s_1/w_1$=2.0 and $s_1 \cdot w_1$=12.5 mm$^2$. The ratio $s_1/w_1$, the so-called internal aspect ratio, ranges between 1 and 5 and, in the preferred range, between 1.5 and 2.5. The product $s_1 \cdot w_1$, which corresponds to the cross-sectional area of a duct of the duct structure, is equal to or larger than 5 mm$^2$. In this embodiment, a (propagation) voltage per unit of length of 35 V/cm is sufficient. In the case of a display device having a height of 60 cm, the necessary (propagation) voltage is less than 2.5 kV, which is considerably less than the voltage of 6 kV which is necessary in the known display device having a height of 30 cm.

It is to be noted that the thickness of the walls is chosen to be larger as the width w and/or the depth s of the ducts increase(s), so that the robustness of the duct structure increases and favorably affects the strength of the display device.

Figure 2B:
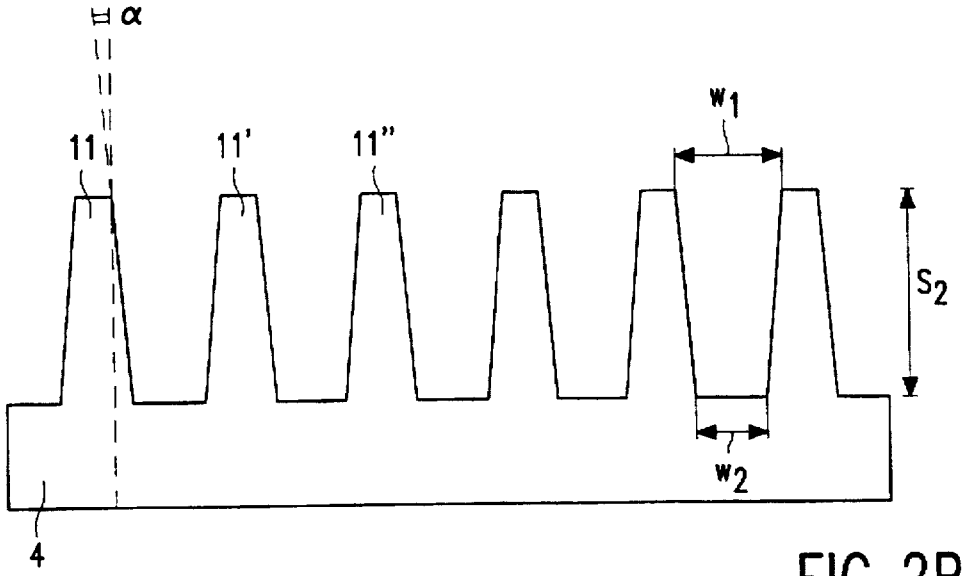

FIG. 2B is a schematic, sectional view of a preferred embodiment of the rear wall 4 and the walls 11, 11', 11" etc. of the ducts 6, 6', 6" etc. of the duct structure, said walls 11, 11', 11" etc. widening gradually in the direction of the rear wall 4. The depth of the ducts of the duct structure (the ducts) is labeled $s_2$ in FIG. 2B. In FIG. 2B, $w_1$ denotes the width of the ducts, that is to say the distance between the walls 11, 11', 11" etc. of the ducts, measured at the location of the portion of the walls 11, 11', 11" etc. which is (most) remote from the rear wall 4, and $w_2$ denotes the width of the ducts, etc., measured at the location of the rear wall 4.

The angle α, which opposing (side) faces of the walls 11, 11', 11" etc. make with the rear wall 4, is measured, as indicated in FIG. 2B, at the location of the portion of the walls 11, 11', 11" etc. which is (most) remote from the rear wall 4. In the embodiment shown in FIG. 2B, the walls 11, 11', 11" etc. of the ducts widen in accordance with a straight line in the direction of the rear wall 4. It is alternatively possible, however, that the walls 11, 11', 11" etc. widen in accordance with a curved line in the direction of the rear wall 4.

If the walls 11, 11', 11" etc. of the ducts 6, 6', 6" etc. widen gradually in the direction of the rear wall 4, the mean width is taken as the width of the ducts 6, 6', 6" etc., for example $w=(w_1+w_2)/2$, wherein, preferably, $w_2>0.5\ w_1$, to preclude that the ducts 6, 6', 6" etc. become too narrow in the vicinity of the rear wall 4.

In a particularly suitable method of manufacturing the preferred embodiments shown in FIG. 2B, in which the rear wall 4 and the walls 11, 11', 11" etc. of the ducts of the duct structure are manufactured in a single piece, and in which the walls 11, 11', 11" etc. and 23, 23', 23" etc. widen in the direction of the rear wall 4, the ducts are pressed in a suitable substrate material (for example glass). Pressing is to be understood to mean herein that, on the one hand, a profiled structure (for example walls) is (are) formed in a quantity of glass, which may be unformed or preformed (for example a (flat) glass plate of the desired thickness), by a movement of a mould, and, on the other hand, that a profiled structure (for example walls) is (are) formed in a preformed (flat) glass plate by a (horizontal) movement of a mould (for example by means of rolling). The desired angle, which opposing faces of the walls make with the rear wall, is obtained by using a suitably shaped pressing member. In this manner, the desired structure is pressed in the substrate in a single process step. Other methods, such as (selective) etching and sand blasting, cannot always suitably be used to form such well-defined profiles in the substrate.

It will be obvious that within the scope of the invention many variations are possible to those skilled in the art.

In general, the invention relates to a thin-type display device having a vacuum envelope. The display device has a transparent front wall, which is provided with a display screen, and comprises at least an electron source and a duct structure, which cooperates with said electron source and extends substantially parallel to the front wall. Ducts of the duct structure serve as electron-propagation means and are provided with walls of an electrically insulating material having a secondary emission coefficient which is suitable for electron propagation. The display device is characterized in that $1 \leqq s/w \leqq 5$ and $s \cdot w \geqq 5$ mm$_2$, where s is the depth of the ducts and w is the width of the ducts. Preferably, the width $w \geqq 2$ mm and the depth $4 \leqq s \leqq 15$ mm. The voltage difference over the length of the ducts, measured parallel to the front wall, is less than 75 V/cm, preferably less than 40 V/cm.

We claim:

1. A thin-type display device (1) which has a vacuum envelope and which comprises a transparent front wall (3), which is provided with a display screen having a pattern of luminescent pixels, which display device (1) includes at least an electron source (5) and a duct structure, which cooperates with said electron source (5) and which extends substantially parallel to the front wall (3), the ducts (6, 6', 6") of the duct structure comprising electron-propagation means with walls (11, 11', 11") of an electrically insulating material having a secondary emission coefficient which is suitable for electron propagation, said electron-propagation means cooperating with the electron source (5) for transporting emitted electrons, characterized in that $1 \leqq s/w \leqq 5$ and $s \cdot w \geqq 5$ mm$^2$, where s indicates the depth of the ducts (6, 6', 6") and w denotes the width of the ducts (6, 6', 6"), in operation, the voltage difference per unit of length, measured over the length of the ducts (6, 6', 6") in a direction parallel to the front wall (3), is less than 75 V/cm.

2. A display device (1) as claimed in claim 1, characterized in that $1.5 \leqq s/w \leqq 2.5$.

3. A display device (1) as claimed in claim 1, characterized in that the width w of the ducts (6, 6', 6") is larger than 1.5 mm.

4. A display device (1) as claimed in claim 1, characterized in that the depth s of the ducts (6, 6', 6") is larger than 3.5 mm.

5. A display device (1) as claimed in claim 1, characterized in that the depth s of the ducts (6, 6', 6") is less than 15 mm.

6. A display device (1) as claimed in claim 1, in which the display device (1) comprises an aperture (8, 8', 8") between the electron source (5) and the ducts (6, 6', 6"), characterized in that the surface area of the aperture (8, 8', 8") is larger than 1 mm$^2$ and the largest dimension of the aperture (8, 8', 8") exceeds 0.5 s.

7. A display device (1) as claimed in claim 1, characterized in that the display device (1) comprises a separate unit which is provided with the electron source (5).

8. A display device (1) as claimed in claim 1, characterized in that, in operation, the voltage difference per unit of length is less than 40 V/cm.

9. A display device (1) as claimed in claim 1, characterized in that the walls of the ducts (6, 6', 6") comprise a material which, in operation, has an effective secondary emission coefficient $\delta_{eff}$, which is substantially equal to 1.

10. A display device (1) as claimed in claim 9, characterized in that the material comprises magnesium oxide.

* * * * *